US006186608B1

(12) United States Patent
Pink

(10) Patent No.: US 6,186,608 B1
(45) Date of Patent: Feb. 13, 2001

(54) ADJUSTABLE HEIGHT PACKAGE RETAINER FOR A REFRIGERATOR DOOR

(75) Inventor: John J. Pink, Cedar Rapids, IA (US)

(73) Assignee: Amana Company, L.P., Amana, IL (US)

( * ) Notice: Under 35 U.S.C. 154(b), the term of this patent shall be extended for 0 days.

(21) Appl. No.: 09/285,372

(22) Filed: Apr. 2, 1999

(51) Int. Cl.[7] ..... A47F 5/00
(52) U.S. Cl. ..... 312/405.1; 312/321.5
(58) Field of Search ..... 312/140.4, 404, 312/405.1, 408, 321.5, 205, 35; 211/59.2, 208, 183; 108/27, 60; 220/4.03

(56) References Cited

U.S. PATENT DOCUMENTS

| | | | | |
|---|---|---|---|---|
| 2,122,336 | | 6/1938 | Berry . | |
| 2,929,078 | * | 3/1960 | Smith et al. | 108/27 X |
| 3,982,798 | | 9/1976 | Fellwock et al. . | |
| 4,346,806 | | 8/1982 | Bustos . | |
| 4,560,072 | | 12/1985 | Burrell . | |
| 4,840,279 | | 6/1989 | Cobb et al. . | |
| 4,867,318 | | 9/1989 | Robson . | |
| 4,889,397 | * | 12/1989 | Ryan | 108/60 X |
| 5,450,968 | | 9/1995 | Bustos . | |
| 5,567,029 | | 10/1996 | Haenisch et al. . | |
| 5,685,624 | | 11/1997 | Lee . | |
| 5,779,331 | | 7/1998 | Fox et al. . | |

FOREIGN PATENT DOCUMENTS

| | | | | |
|---|---|---|---|---|
| 201307 | | 4/1956 | (AU) . | |
| 453976 | | 1/1949 | (CA) . | |
| 2032259 | * | 5/1980 | (GB) | 108/27 |
| 590977 | * | 4/1959 | (IT) | 312/321.5 |

* cited by examiner

*Primary Examiner*—Janet M. Wilkens
(74) *Attorney, Agent, or Firm*—Bracewell & Patterson, L.L.P; Ben D. Tobor

(57) ABSTRACT

A multiple height package retainer for a refrigerator door and a method for adjusting an adjustable height package retainer for a refrigerator door includes a shelf body and a retainer member. The retainer member may have a first position and a second position for holding packages of varying height.

10 Claims, 6 Drawing Sheets

ADJUSTABLE HEIGHT PACKAGE RETAINER FOR A REFRIGERATOR DOOR

BACKGROUND OF THE INVENTION

1. Field of the Invention

The invention relates to adjustable height package retainers for holding packages on a refrigerator door.

2. Description of Related Art

It is desirable to fit as much as possible into one refrigerator. It has been found that storing items on the shelves on the door of a refrigerator is one way of fitting more items into a refrigerator, while still allowing easy access to the items in the refrigerator.

By nature, the door of a refrigerator is continually opened and closed. It has been found that the food items stored on the shelves on the door of the refrigerator, if not properly retained on the shelves on the door, may fall from the shelves while the door is being opened or shut. As this situation is not desirable, various ways of retaining the items on the shelves have been devised. One way of keeping the items or packages on the shelves is to install a fixed bracket, or rail, on the door in front of the packages, thereby preventing the packages from tipping while the door is moving. Unfortunately, such a configuration is typically not adjustable. Therefore, shorter or smaller packages are difficult or inconvenient to access because the bracket is in the way. Further, taller packages may tip over and fall out. Generally, it is not possible to install a fixed bracket at such a height that will accommodate the wide range of package sizes that one may desire to store on a shelf on the door of a refrigerator.

Because of the inherent problems with non-adjustable package retainers, adjustable height package retainers have been devised. However. these package retainers have a variety of disadvantages. One disadvantage is that some of the package retainers are designed to adjust by pivoting about a fixed point. As a result, the width of a package that can be accommodated on the shelf changes as the height of the retainer is adjusted. Another problem with the adjustable height package retainers of the prior art is that they are typically constructed using several parts and their assembly can be difficult. A further problem with these pivoting package retainers is that they can be difficult for the user to adjust. Finally, many of the adjustable height package retainers can not be locked in place and as a result, the packages on the shelf are allowed too great a freedom of movement and unwanted tipping can occur.

Accordingly, prior to the development of the present invention, there has been no adjustable height package retainer for a refrigerator door which: can accommodate packages of equal width at all heights of adjustment; is constructed using few parts; is easy to assemble; is easy for the refrigerator user to adjust; stays in place after adjustment; and prevents unwanted tipping of the packages stored on the door of the refrigerator.

SUMMARY OF THE INVENTION

The present invention relates generally to the field of refrigerators. More particularly the invention relates to a method and apparatus for retaining packages of various heights on the door of a refrigerator.

In accordance with the invention, the foregoing advantages have been achieved through the apparatus for an adjustable height package retainer for a refrigerator door of the present invention. The adjustable height package retainer for a refrigerator door may include: a shelf body having a first opening, a second opening and a bottom wall; a retainer member having at least one leg, and a retaining segment, the retainer member having first and second positions; the retainer member being disposed with respect to the shelf body in the first position with the at least one leg fitting matingly into the first opening in the shelf body, and the retaining segment has a first height from the bottom wall of the shelf body; and the retainer member being disposed with respect to the shelf body in the second position with the at least one leg fitting matingly into the second opening in the shelf body, and the retaining segment has a second height from the bottom wall of the shelf body.

Another feature of the present invention may be that the first and second openings each have a longitudinal axis disposed substantially perpendicular to the bottom wall. A further feature of the present invention is that the retainer member may have a first leg and a second leg, and the first leg fits matingly into the first opening and the second leg fits matingly into the second opening in the first position, and the first leg fits matingly into the second opening and the second leg fits matingly into the first opening in the second position.

In another embodiment of the present invention, an adjustable height package retainer for a refrigerator door may include: a retainer member having at least one leg, the at least one leg being irregularly shaped; a shelf body having at least one opening, the at least one opening being irregularly shaped, the at least one irregularly shaped opening matingly receiving the at least one irregularly shaped leg in a first orientation, and in the first orientation, the at least one irregularly shaped leg penetrates the at least one irregularly shaped opening to a first depth, and the at least one irregularly shaped opening matingly receiving the at least one irregularly shaped leg in a second orientation, and in the second orientation the at least one irregularly shaped leg penetrates the at least one irregularly shaped opening to a second depth.

Another feature of the present invention is that the retainer member may have two legs. A further feature of the present invention is that the at least one irregularly shaped leg may have a protrusion, and the at least one irregularly shaped opening may have a notch.

A further feature of the present invention is that the protrusion on the at least one irregularly shaped leg aligns with the notch in the at least one irregularly shaped opening in the first orientation, and the protrusion on the at least one irregularly shaped leg does not align with the notch in the at least one irregularly shaped opening in the second orientation. In another aspect of the present invention may include that the protrusion is a ball, and the notch is large enough to matingly receive the ball, and in the first orientation, the ball fits matingly into the notch.

In accordance with the present invention, the foregoing advantages have also been achieved through the method of adjusting an adjustable height package retainer of the present invention. This aspect may include the steps of: providing a shelf body having a first opening, a second opening, and a bottom wall; providing a retainer member having a first leg, a second leg, and a retaining segment; inserting the first leg into the first opening, and inserting the second leg into the second opening, with the retaining segment having a first height from the bottom wall of the shelf body; removing the first leg from the first opening, and removing the second leg from the second opening; inserting the first leg into the second opening in the shelf body, and inserting the second leg into the first opening of the shelf body, with the retaining segment having a second height from the bottom wall of the shelf body.

In accordance with the present invention, the foregoing advantages have also been achieved through the refrigerator of the present invention. The refrigerator of the present invention may include: a refrigerator housing; a refrigerator door; an adjustable height package retainer disposed on the refrigerator door, the adjustable height package retainer having a shelf body, the shelf body having a first opening, a second opening, and a bottom wall, the adjustable height package retainer having a retainer member, the retainer member having at least one leg, and a retaining segment, the retainer member having first and second positions, the retainer member being disposed with respect to the shelf body in the first position with the at least one leg fitting matingly into the first opening in the shelf body, and the retaining segment has a first height from the bottom wall of the shelf, and the retainer member being disposed with respect to the shelf body in the second position with the at least one leg fitting matingly into the second opening in the shelf body, and the retaining segment has a second height from the bottom wall of the shelf.

The adjustable height package retainer for a refrigerator door and method for adjusting an adjustable height package retainer for a refrigerator door, when compared to previously proposed prior art adjustable height package retainers and methods and apparatus for adjusting adjustable height package retainers, are believed to have the advantages of: being able to accommodate packages of equal width at all heights of adjustment; being constructed using few parts; being easy to assemble; being easy for the refrigerator user to adjust; staying in place after adjustment; and preventing unwanted tipping of the packages stored on the door of the refrigerator.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
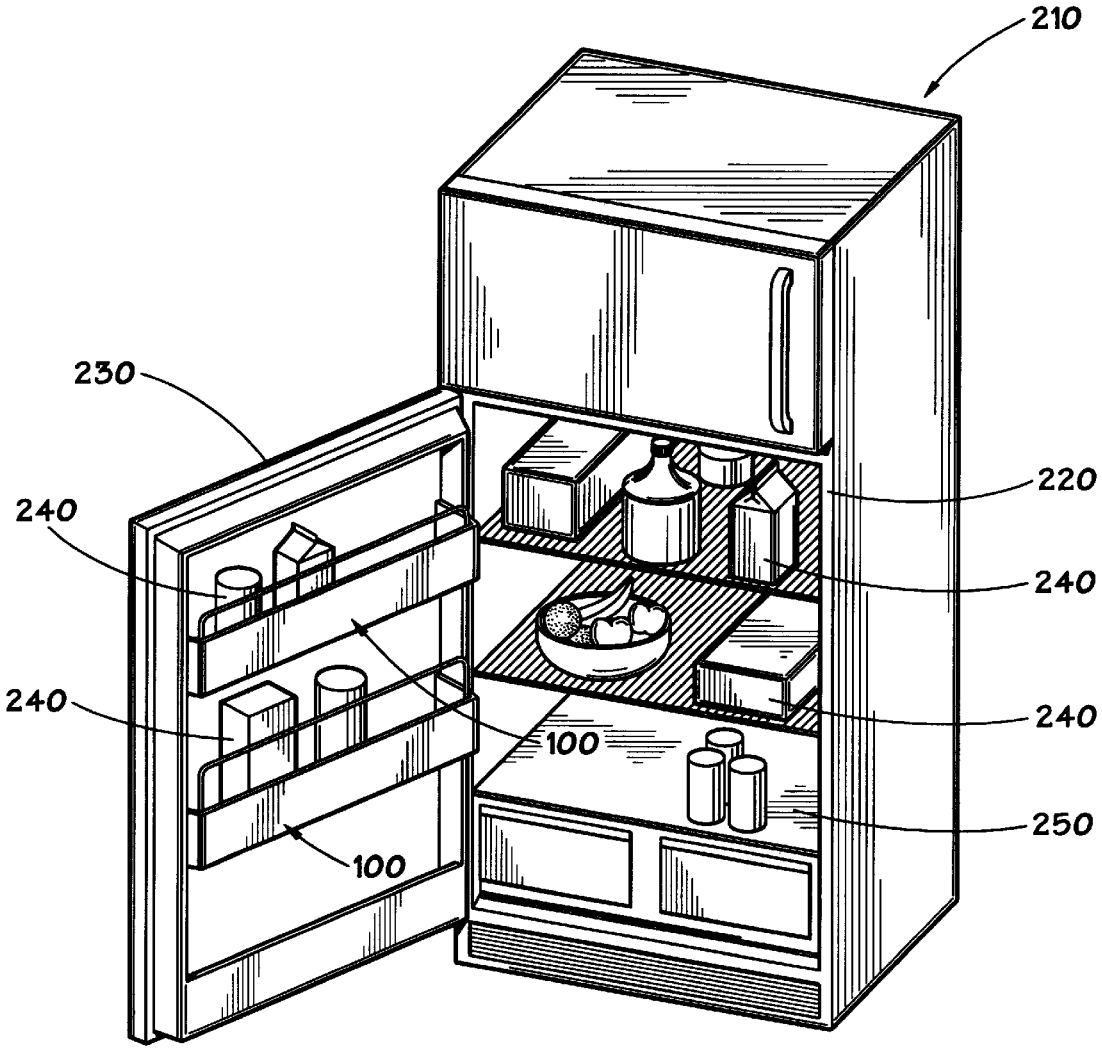
FIG. 1 is a front, perspective view of a refrigerator with an open door showing two adjustable height package retainers.

Referring to FIG. 1, a refrigerator 210 is shown with a door 230 in an open position. The refrigeration compartment 250 is enclosed by a refrigerator housing 220. FIG. 1 shows two adjustable height package retainers 100 in accordance with the present invention, on the door 230 of the refrigerator 210. Also shown are packages 240 being stored both on the door 230 and in the refrigeration compartment 250.

Figure 2:
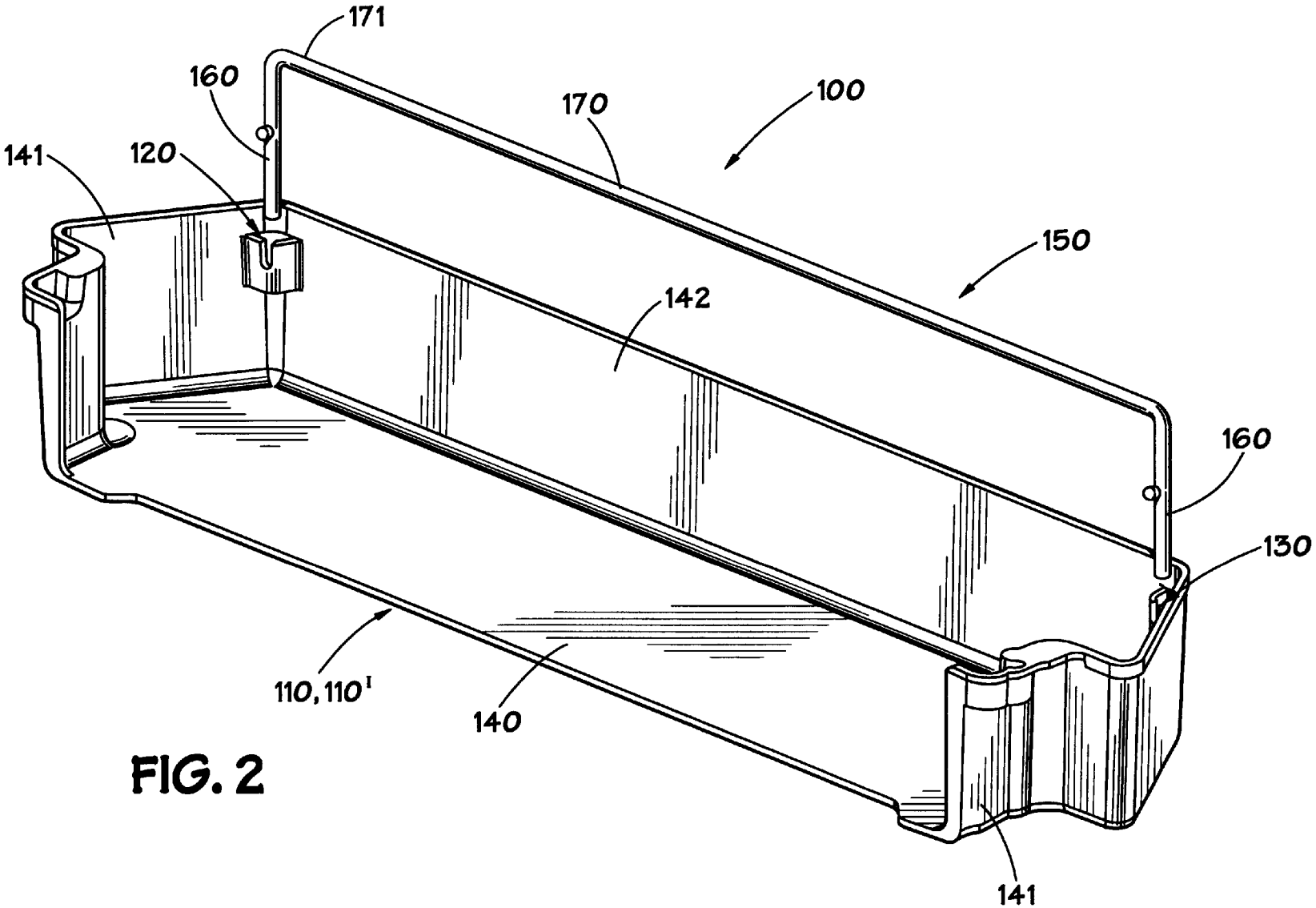
FIG. 2 is a perspective view of an adjustable height package retainer in accordance with the present invention.

With reference to FIG. 2, an adjustable height package retainer 100 is shown in accordance with the present invention. Generally the adjustable height package retainer 100 is shown to generally comprise a shelf body 110 and a retainer member 150. The shelf body 110 may be an elongated trough 110' which may be suitable for storing several packages 240 (FIG. 1). The elongated trough 110' may preferably include a front wall 142 and upwardly extending side walls 141. If desired, trough 110' could include a rear wall (not shown). The shelf body 110 may be provided with any suitable support member, or brackets (not shown), for mounting the shelf body 110 on the door 230 of refrigerator 210. The shelf body 110 may take on any of a number of different shapes. For example, the shelf body 110 could be shorter in length and therefore suitable for holding very few or even just a single package 240. Alternatively, the shelf body 110 could be narrow in width and therefore suitable for holding only narrow packages 240. Preferably, the shelf body 110 has a first opening 120 and a second opening 130 formed therein and a bottom wall 140. Generally, the bottom wall 140 supports the packages 240 in the manner of a shelf when the adjustable height package retainer 100 is properly installed on the door 230 of the refrigerator 210.

Figure 5:
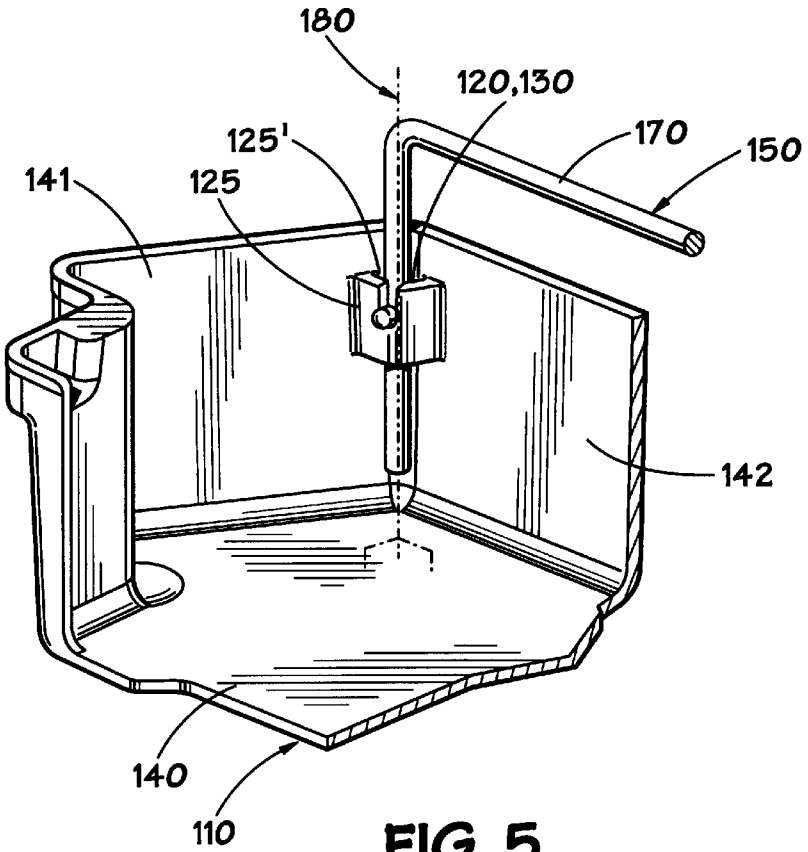
FIG. 5 is an enlarged, perspective view of a portion of the adjustable height package retainer of the present invention.
Figure 11:
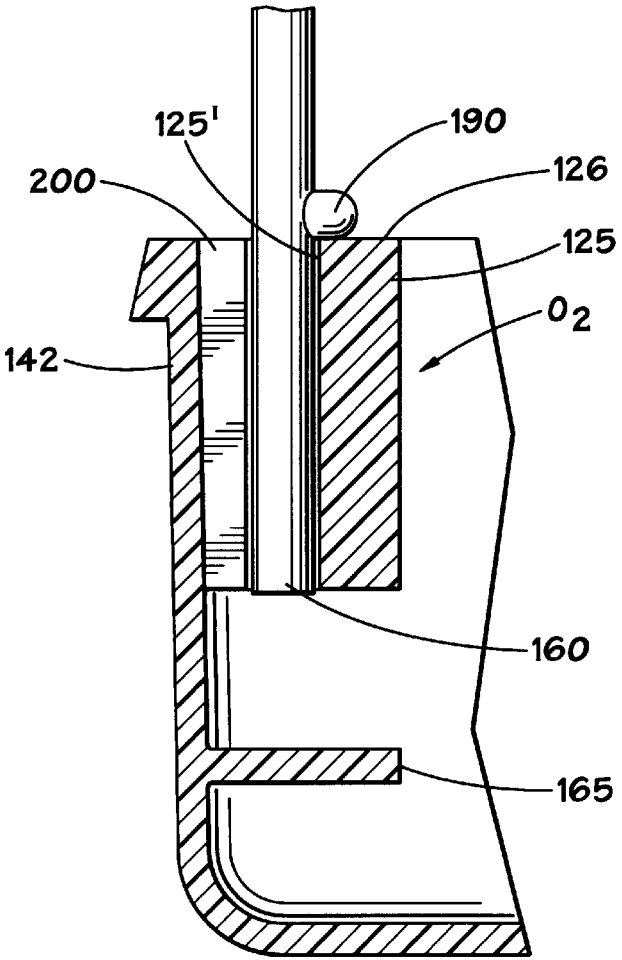
FIG. 11 is a partial cross-sectional view of another embodiment of a shelf body with a portion of a retainer member in a second orientation with respect to the shelf body.
Figure 10:
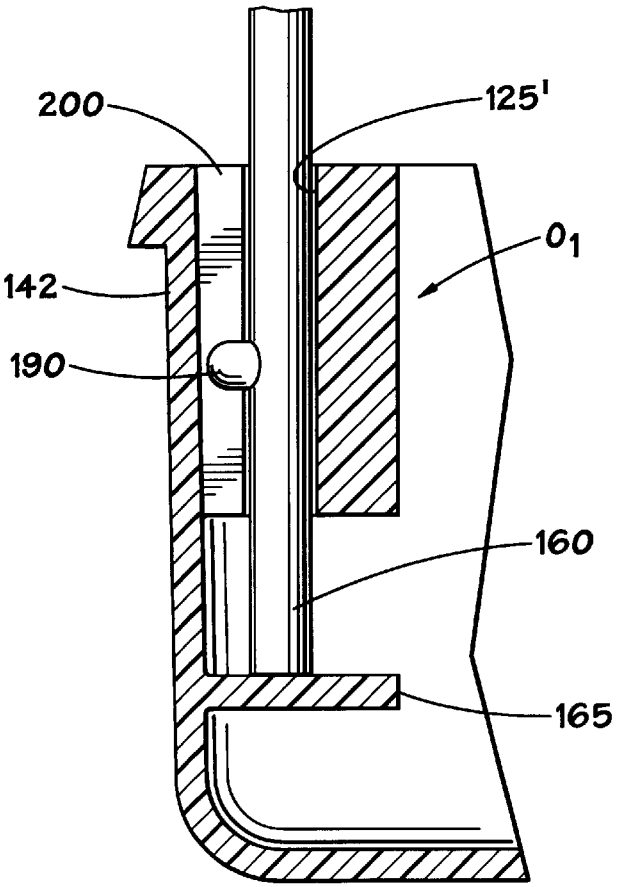
FIG. 10 is a partial cross-sectional view of another embodiment of a shelf body with a portion of a retainer member in a first orientation with respect to the shelf body.

With reference to FIG. 5, the openings 120, 130 are typically defined by an outer wall 125 having an interior surface 125' (FIGS. 5, 10 and 11). The outer wall 125 is shown as being attached to, or formed integral with the front wall 142 and the side wall 141 of the shelf body 110. The openings 120, 130 are generally cylindrical in shape but may be any shape suitable for receiving leg 160, as hereinafter described. Further, the openings 120, 130 need not be attached to, or formed integral with, the front wall 142 or the side wall 141 of the shelf body 110. If desired, the outer wall 125 could be otherwise supported by, or formed as, a post or other fixture (not shown). Further, the outer wall 125 may be attached only to the front wall 142, or only to the side wall 141, or may be formed integral to either wall.

Figure 3:
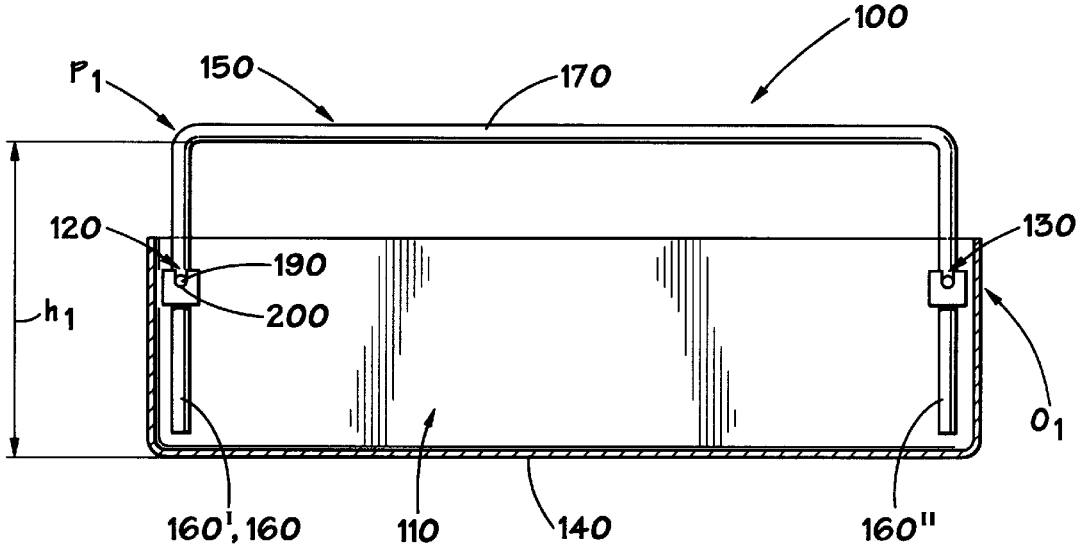
FIG. 3 is a front view of an adjustable height package retainer in accordance with the present invention showing the retainer member in a first orientation.
Figure 4:
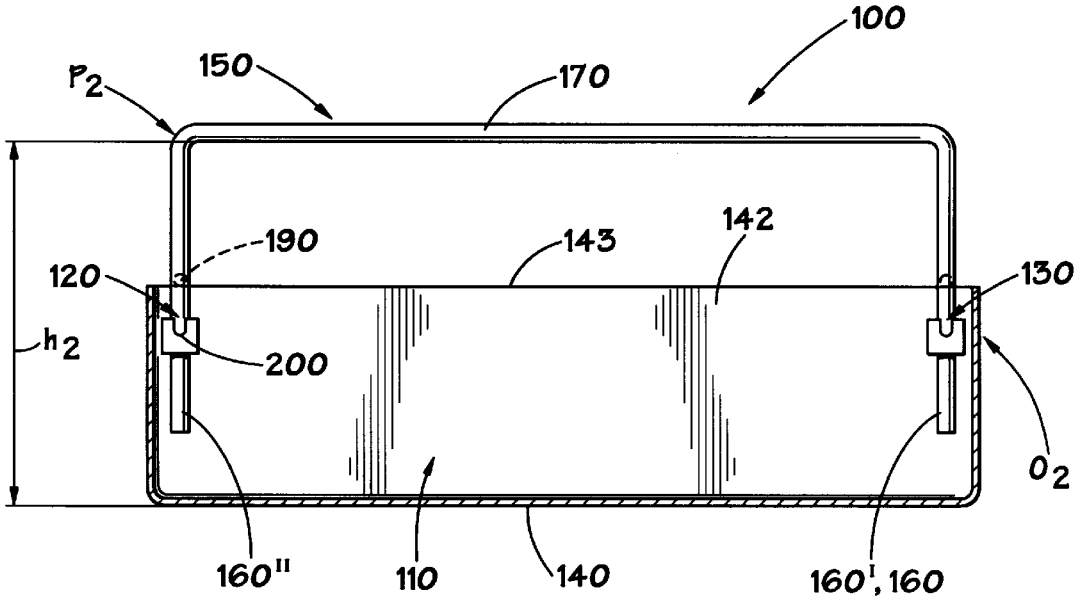
FIG. 4 is a is a front view of an adjustable height package retainer in accordance with the present invention showing the retainer member in a second orientation.

Referring to FIGS. 2, 3, and 4, the adjustable height package retainer 100 generally includes a retainer member 150. The retainer member may have at least one leg 160 and a retaining segment 170. The retaining segment 170 is shown as an elongate member, or rod, 171 (FIG. 2) having a circular cross sectional configuration. However, any cross-sectional configuration would be suitable. For example, the retaining segment 170 may be a bar with a square or rectangular cross-section. In the figures, the retainer member 150 is shown with two legs 160. It is contemplated that any number of legs 160, as desired, could be employed depending upon the requirements of the particular adjustable height package retainer 100, such as the length of the shelf body 110 and the size, shape and weight of the packages 240 to be stored. For example, a retainer member 150 may have only one leg 160, centrally located with respect to the retaining segment 170, thereby forming a T shape, the top of the T forming the retaining segment 170 and the trunk of the T forming the leg 160.

The retainer member 150 preferably has a first position $P_1$ (FIG. 3) and a second position $P_2$ (FIG. 4) with respect to the shelf body 110. As shown in FIG. 3, in the first position $P_1$, the leg 160 preferably fits matingly into the first opening 120 in the shelf body 10. For the leg 160 to fit "matingly" into the opening 120, 130 means that the leg 160 penetrates the openings 120, 130. Preferably the interior surface 125' of outer wall 125 provides some lateral support to the leg. Preferably the leg 160 makes contact with the outer wall 125, and the contact is a sliding contact such that the user of the refrigerator can easily remove the retainer member when the user desires to adjust the height of the retainer member with respect to the shelf body. Generally, in the first position $P_1$, the retaining segment 170 has a first height $h_1$ (FIG. 3) from the bottom wall 140 of the shelf body 110. In the second position $P_2$ (FIG. 4), the leg 160 fits matingly into the second opening 130 in the shelf body 110. In the second position $P_2$, the retaining segment 170 has a second height $h_2$ from the bottom wall 140 of the shelf body 110. In this manner, depending upon the height of the packages 240 stored in the adjustable height package retainer 100, the retaining segment 170 of the retainer member may be situated at either of two heights, $h_1$ or $h_2$. The user of the refrigerator 210 can choose the desired height, usually dependent upon the height of the packages 240 to be stored on the shelf body 110.

It is generally desirable for the retainer member 150 to be adjustable in substantially a vertical direction. In this manner, when the retainer member 150 is adjusted, there is no change in the width of packages 240 that can fit on the shelf body 140. Therefore, as shown in FIG. 5, the first and second openings 120, 130 may have a longitudinal axis as indicated by arrow 180, disposed substantially perpendicular to the bottom wall 140 of the shelf body 110. In this perpendicular orientation, the retainer member 150 will be constrained to move in a substantially vertical direction while the leg 160 is fitted matingly in the openings 120, 130.

The adjustable height package retainer 100 may have two legs 160. There may be a first leg 160' and a second leg 160". As shown in FIGS. 3 and 4, when the retainer member 150 is in the first position $P_1$, the first leg 160' may fit matingly into the first opening 120 and the second leg 160" may fit matingly into the second opening 130. When the retainer member 150 is in the second position $P_2$, the first leg 160' may fit matingly into the second opening 130 and the second leg 160" may fit matingly into the first opening 120. The user of the refrigerator will typically move the retainer member from the first position $P_1$ to the second position $P_2$ by hand.

The retainer member 150 of the adjustable height package retainer 100 may have at least one leg 160 that is irregularly shaped. For a leg 160 to be "irregularly shaped" means that one segment of the length of the leg 160 has an irregularity, or a cross-sectional configuration that is different in shape than other segments of the leg 160. The shelf body 110 may have at least one opening 120, 130 that is irregularly shaped. For an opening to be "irregularly shaped" means that one segment of the length of the opening has an irregularity, or a cross-sectional configuration that is different in shape than other segments of the opening 120, 130. Referring to FIGS. 6–11, the irregularly shaped openings 120, 130 (FIGS. 8, 9) may matingly receive the irregularly shaped leg 160 of the retainer member 150 in either of two orientations $O_1$, or $O_2$. In the first orientation $O_1$ the irregularly shaped opening 120, 130 matingly receives the irregularly shaped leg 160. In the first orientation $O_1$, the irregularly shaped leg 160 may penetrate the irregularly shaped opening 120, 130 to a first depth indicated by $D_1$. It is contemplated that the depth to which the irregularly shaped leg 160 will penetrate the irregularly shaped opening 120, 130 will depend upon the positioning of the irregularity along the length of the legs 160 or the openings 120, 130. The exact depth desired may be determined according to the expected heights of the packages 240 (FIG. 1) to be stored in the refrigerator 210. In a second orientation $O_2$, the irregularly shaped leg 160 will penetrate the irregularly shaped openings 120, 130 to a second depth $D_2$. The different depths, $D_1$ and $D_2$, to which the irregularly shaped leg 160 penetrates the irregularly shaped opening 120, 130 are determined by the placement of the irregularity as hereinafter explained. In this manner, the user of the refrigerator 210 can select the desired depth by changing the orientation of the retainer member 150 with respect to the opening 120, 130.

Figure 6:
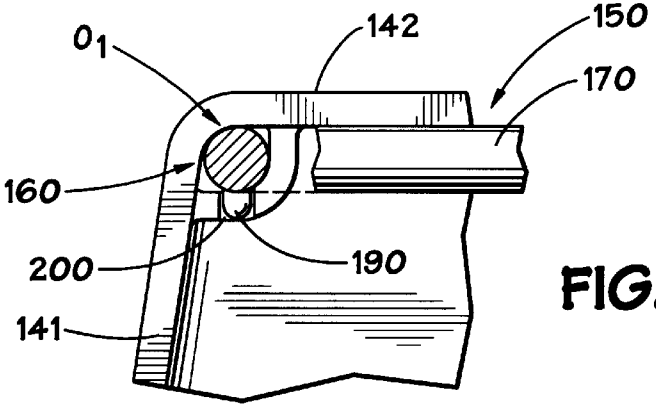
FIG. 6 is a top view of a portion of the retainer member in a first orientation with respect to the shelf body.
Figure 7:
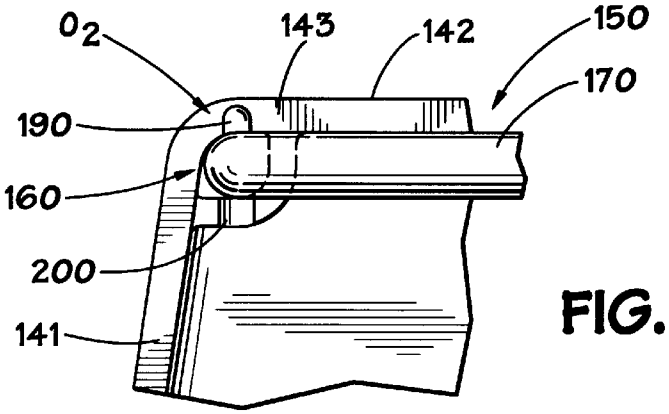
FIG. 7 is a top view of a portion of the retainer member in a second orientation with respect to the shelf body.
Figure 9:
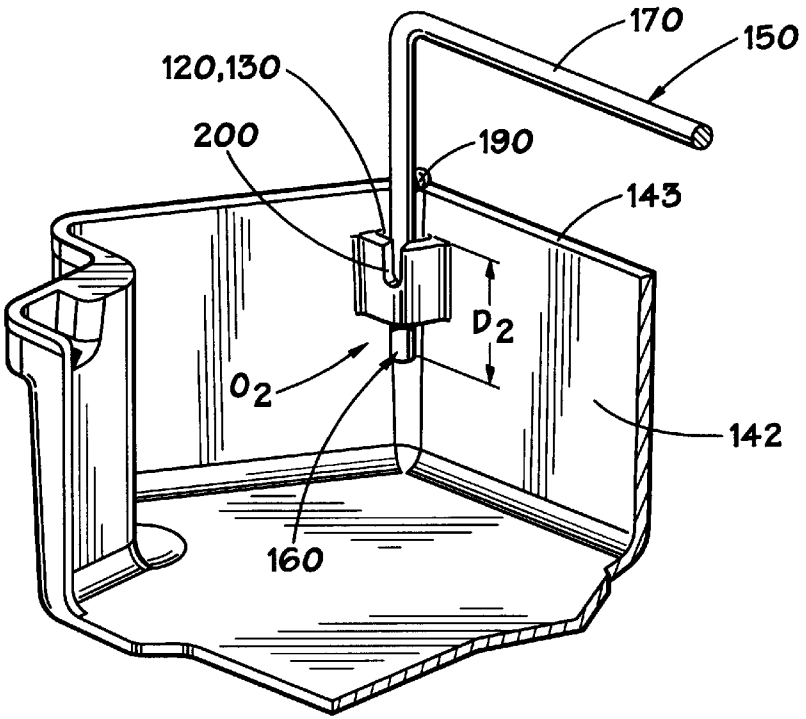
FIG. 9 is a perspective view of a portion of the retainer member in a second orientation with respect to the shelf body.
Figure 8:
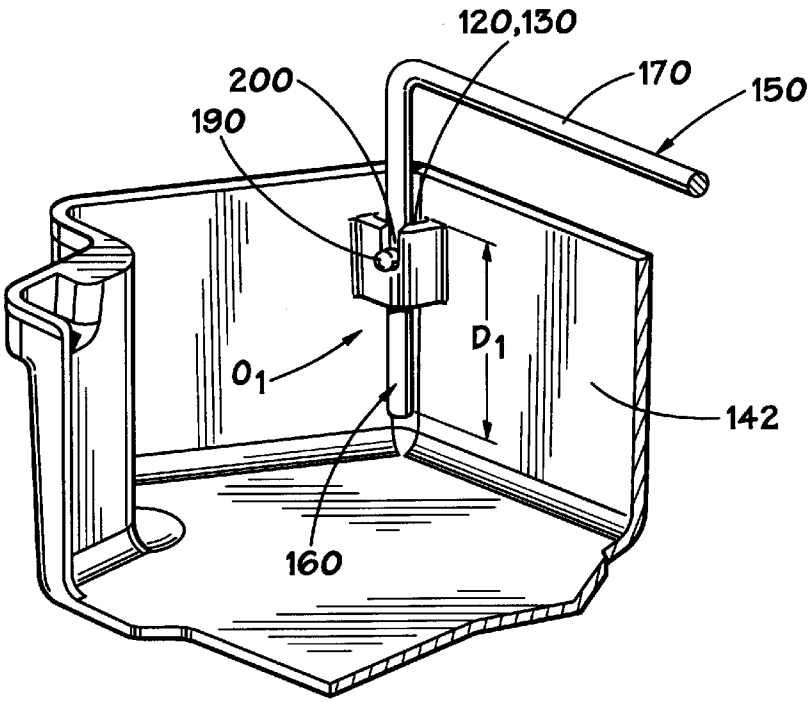
FIG. 8 is a perspective view of a portion of the retainer member in a first orientation with respect to the shelf body.

The retainer member 150 may have two legs 160. Either one, or both, of the legs 160 may be irregularly shaped, as previously described. Referring to FIGS. 8 and 9, the irregularly shaped leg 160 may have an irregularity or protrusion 190 on one side of the leg 160. This protrusion 190 causes the cross section of the leg 160 to be larger in the region of the protrusion 190. There also may be a notch 200 in the outer wall 125 (FIG. 5) defining openings 120, 130, which causes the cross-sectional configuration of the openings 120, 130 to be irregularly shaped in the region of the notch 200. As seen in FIGS. 6, 8, and 10, in the first orientation $O_1$, the protrusion 190 aligns with the notch 200. In this manner, the protrusion 190 may enter the notch 200, thereby allowing the leg 160 to enter the openings 120, 130 further than if the notch 200 were not present. In the second orientation $O_2$, of FIGS. 7, 9, and 11, the protrusion 190 does not align with the notch 200. As such, the protrusion 190 can not enter the notch 200, and therefore, in the second orientation $O_2$, the leg 160 may not enter the opening 120, 130 as deeply as it may in the first orientation $O_1$. Preferably, in the second orientation $O_2$, the protrusion 190 abuts the top 126 of the outer wall 125 (FIGS. 7, 11) or abuts the top 143 of front wall 142 (FIGS. 4, 9).

In FIGS. 2, 3, 4, 5, 8 and 9, the notch 200 is shown as being disposed on the side of the outer wall 125 opposite the front wall 142. In FIGS. 6, 7, 10, and 11, an alternative embodiment of the present invention is shown, wherein the notch 200 is disposed on the side of the outer wall 125 nearest the front wall 142. Either configuration may be employed depending upon the specific sizes and shapes of the shelf body 110 and refrigerator door 230 used. Hereinafter, figures showing both embodiments will be used to describe the invention.

In one specific embodiment of the invention, the protrusion 190 has the shape of a ball and the notch 200 is large enough to matingly receive the ball 190. The protrusion 190 could be configured in any of a variety of shapes. For example, a cube shape or a pyramid shape could be used. In the embodiment shown in the figures, the ball 190 enters the notch in the first orientation $O_1$.

As shown in FIG. 5, the protrusion 190 abuts the notch to stop the leg 160 from penetrating the opening 120, 130. Alternatively, as shown in FIGS. 10 and 11, there may be a bottom leg support 165 disposed below the opening 120, 130. In this configuration, the protrusion 190 may slide in the notch until the leg 160 abuts the bottom leg support 165 and stops the leg 160 from penetrating the opening 120, 130 any further. The bottom leg support may be attached to the side wall 141, the front wall 142 or the bottom 140 of the shelf body 110.

The present invention further contemplates a method for adjusting the height of an adjustable height package retainer 100. As shown in FIGS. 3 and 4, the adjustable height package retainer may have a shelf body 110, a first opening 120, a second opening 130 and a bottom wall 140. The retainer member 150 may have a first leg 160', a second leg 160" and a retaining segment 170. The user of the refrigerator (FIG. 1) 210 would adjust the retaining segment 170 of the retaining member 150 to a first height $h_1$ by inserting the first leg 160' into the first opening 120 and inserting the second leg 160" into the second opening 130. As shown in FIGS. 3 and 8, the protrusion 190 enters the notch 200. To adjust the adjustable height package retainer 100 to a second height $h_2$, the first leg 160' is removed from the first opening 120 and the second leg 160" is removed from the second opening 130. The first leg 160' is then inserted into the second opening 130 and the second leg 160" is inserted into the first opening 120. As shown in FIGS. 4 and 9, the protrusion 190 does not align with the notch 200 and as a result, the retaining segment has a second height $h_2$ with respect to the bottom wall 140 of the shelf body 110.

It is to be understood that the invention is not limited to the exact details of construction, operation, exact materials or embodiments shown and described, as obvious modifications and equivalents will be apparent to one skilled in the art; for example, instead of the leg 160 having a protrusion and the opening 120, 130 having a notch, the leg 160 may have a notch and the opening 120, 130 may have a protrusion. Accordingly, the invention is therefore to be limited only by the scope of the appended claims.

I claim:

1. An adjustable height package retainer for a refrigerator door comprising:

a shelf body having a first opening, a second opening, and a bottom wall;

a retainer member having at least one leg, and a retaining segment, the retainer member having first and second positions, and the retainer member having first and second heights, the first position corresponding to the first height, and the second position corresponding to the second height;

the retainer member being disposed with respect to the shelf body in the first position with the at least one leg fitting matingly into the first opening in the shelf body, whereby the retaining segment is disposed at the first height from the bottorr wall of the shelf body; and the retainer member being disposed with respect to the shelf body in the second position with the at least one leg fitting matingly into the second opening in the shelf body, whereby the retaining segment is disposed at the second height from the bottom wall of the shelf body.

2. The adjustable height package retainer of claim 1, wherein the first and second openings each have a longitudinal axis disposed substantially perpendicular to the bottom wall.

3. The adjustable height package retainer of claim 2 wherein the retainer member has a first leg and a second leg, and the first leg fits matingly into the first opening and the second leg fits matingly into the second opening in the first position, and the first leg fits matingly into the second opening and the second leg fits matingly into the first opening in the second position.

4. An adjustable height package retainer for a refrigerator door comprising:

a retainer member having at least one leg, the at least one leg being irregularly shaped;

a shelf body having at least one opening, the at least one opening being irregularly shaped, the at least one irregularly shaped opening matingly receiving the at least one irregularly shaped leg in a first orientation, and in the first orientation, the at least one irregularly shaped leg penetrates the at least one irregularly shaped opening to a first depth, and the at least one irregularly shaped opening matingly receiving the at least one irregularly shaped leg in a second orientation, and in the second orientation the at least one irregularly shaped leg penetrates the at least one irregularly shaped opening to a second depth.

5. The adjustable height package retainer of claim 4, wherein the retainer member has two legs.

6. The adjustable height package retainer of claim 4, wherein the at least one irregularly shaped leg has a protrusion, and the at least one irregularly shaped opening has a notch.

7. The adjustable height package retainer of claim 6, wherein the protrusion on the at least one irregularly shaped leg aligns with the notch in the at least one irregularly shaped opening in the first orientation, and the protrusion on the at least one irregularly shaped leg does not align with the notch in the at least one irregularly shaped opening in the second orientation.

8. The adjustable height package retainer of claim 6, wherein the protrusion is a ball, and the notch is large enough to matingly receive the ball, and in the first orientation, the ball fits matingly into the notch.

9. A method for adjusting the height of an adjustable height package retainer for a refrigerator door comprising the steps of:

providing a shelf body having a first opening, a second opening, and a bottom wall;

providing a retainer member having a first leg, a second leg, and a retaining segment;

inserting the first leg into the first opening, and inserting the second leg into the second opening, thereby positioning the retaining segment to a corresponding first height from the bottom wall of the shelf body;

removing the first leg from the first opening, and removing the second leg from the second opening;

inserting the first leg into the second opening in the shelf body, and inserting the second leg into the first opening of the shelf body, thereby positioning the retaining segment to a corresponding second height from the bottom wall of the shelf body.

10. A refrigerator comprising:

a refrigerator housing;

a refrigerator door;

an adjustable height package retainer disposed on the refrigerator door, the adjustable height package retainer having a shelf body, the shelf body having a first opening, a second opening, and a bottom wall, the adjustable height package retainer having a retainer member, the retainer member having at least one leg, and a retaining segment, the retainer member having first and second positions, and the retainer member having first and second heights, the first position corresponding to the first height, and the second position corresponding to the second height, the retainer member being disposed with respect to the shelf body in the first position with the at least one leg fitting matingly into the first opening in the shelf body, whereby the retaining segment is disposed at the first height from the bottom wall of the shelf body, and the retainer member being disposed with respect to the shelf body in the second position with the at least one leg fitting matingly into the second opening in the shelf body, whereby the retaining segment is disposed at the second height from the bottom wall of the shelf body.

* * * * *

UNITED STATES PATENT AND TRADEMARK OFFICE

CERTIFICATE OF CORRECTION

PATENT NO. : 6,186,608 B1
DATED : February 13, 2001
INVENTOR(S) : John J. Pink

It is certified that error appears in the above-identified patent and that said Letters Patent is hereby corrected as shown below:

Claim 1, Column 7,
Line 51, "bottorr" should read "bottom"

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*